US005443237A

United States Patent [19]

Stadtmauer

[11] Patent Number: 5,443,237

[45] Date of Patent: Aug. 22, 1995

[54] COMPUTER KEYBOARD SUPPORT SYSTEM

[76] Inventor: Seymour H. Stadtmauer, 11539 E. De La O Rd., Scottsdale, Ariz. 85255

[21] Appl. No.: 239,235

[22] Filed: May 6, 1994

[51] Int. Cl.[6] ..... A47B 19/00

[52] U.S. Cl. ..... 248/441.1; 248/279; 248/284; 248/118.3; 248/918

[58] Field of Search ..... 248/918, 346, 284, 118, 248/441.1, 118.1, 118.3, 276, 240, 240.4, 278, 279

[56] References Cited

U.S. PATENT DOCUMENTS

| | | | |
|---|---|---|---|
| 4,616,798 | 10/1986 | Smeenge et al. | 248/279 X |
| 5,211,367 | 5/1993 | Musculus | 248/279 |
| 5,257,767 | 11/1993 | McConnell | 248/918 X |
| 5,351,897 | 10/1994 | Martin . | |
| 5,377,951 | 1/1995 | Johnson et al. | 248/918 X |
| 5,407,156 | 4/1995 | Rossman et al. | 248/118.1 |

OTHER PUBLICATIONS

Ergonomic Solutions at Work Brochure "Mini-Arm".
Proformix Brochure "Ergonomical Ergonomics" The Keyboard System.
Work Rite Brochure "Adjustble Arm Products for Keyboard and Mouse".
Haworth Brochure "Clamp-on AKP".

*Primary Examiner*—David M. Purol
*Attorney, Agent, or Firm*—M. Reid Russell

[57] ABSTRACT

A computer keyboard support system that includes an articulating arm with first and second pivot couplings spanning between pairs of parallel lock plates and links, the lock plates to be clamped against the links and ends of the pivot couplings by operation of a lock bolt that is arranged for manual operation to maintain articulating arm positioning, as set at the first and second pivot couplings. The first pivot coupling is mounted to a top plate that is arranged for fitting into a track that is mounted to an undersurface of a work table, allowing the top plate and connected articulating arm to be pulled outwardly from the table edge. Which track may also accommodate a height adjustable document holder. The articulating arm is vertically movable around the first pivot coupling to be lowered from a horizontal attitude, with the second pivot coupling arranged with a keyboard holder mount as the second pivot coupling that may be tilted to provide a tilt that is up to a negative nine (9) degrees from the horizontal a keyboard holder or mouse pad connected thereto. The keyboard holder is to accommodate a computer keyboard maintained thereon and may provide for connecting a mouse pad thereto to extend outwardly from the side or opposite sides of the keyboard holder. The mouse pad may be fixed or arranged to tilt from the horizontal, and the keyboard holder, along a forward edge, preferably includes a height adjustable palm rest that can include a padded top surface.

24 Claims, 9 Drawing Sheets

85
87
94
94a
89
90
91
92
93
93a
95
96
97
98
98a
99
100
103
104
105
106
107
108
109
110
110a
111
111a
112
113
113a

COMPUTER KEYBOARD SUPPORT SYSTEM

BACKGROUND OF THE INVENTION

1. Field of the Invention

The invention relates to keyboard support systems and in particular to work place ergonomic computer keyboard support systems that are adjustable for minimizing individual worker fatigue and improving their efficiency.

2. Prior Art

Computer tables that include pull-out keyboard sections for supporting a computer keyboard with the computer display and driver maintained on the table top are, or course, not new. Further, while some arrangements have provided for an inclusion of computer accessories, such as document holders, mouse pads, and the like, such have not been included as components of a single system, and no system has involved a manufacture of all the system components, less connectors, from a hard plastic material, such as an ABS plastic, as does the invention.

While recent keyboard support systems have provided a capability for height adjustment of a keyboard support, and are capable of both height adjustment and articulation whereby an operator can both raise and lower and appropriately tilt the keyboard support table towards them, such have not involved a single and yet reliable articulating arm arrangement like that of the invention. Further, such earlier systems have generally employed separately mounted system components rather than an integral mouse pad and copy holder like that of the invention. Also unique to the invention is the inclusion of a horizontally movable track mounted keyboard support and mouse pad arrangements, which mouse pad can be tilted from the horizontal, and a height adjustable keyboard support palm rest.

BRIEF SUMMARY OF THE INVENTION

It is therefore a principal object of the present invention in a computer keyboard support system to provide a system for mounting onto a conventional computer table that is arranged to support a computer keyboard and can be articulated to allow a computer operator to move the keyboard support horizontally, to lower the support from a stowed attitude and to tilt that support at a negative angle from the horizontal.

Another object of the invention is to provide a system that provides a mouse pad for attachment, to extend outwardly at keyboard height, from either side of the keyboard support, can be arranged to pivot from the horizontal to tilt relative to the computer keyboard and can be fitted to the articulating arm as a substitute for the keyboard support.

Another object of the invention is to provide a system that includes a vertically adjustable document holder that can, along with the articulating arm, be fitted to a double track mounted to the computer table, or can be arranged to stand alone.

Another object of the invention is to provide a keyboard support that includes a palm rest that is arranged to be vertically adjustable, can be locked at a selected height above the support, and can be padded or not.

Still another object of the invention is to provide an articulating arm component for a keyboard support system that is operated so as to allow the keyboard support to be conveniently raised or lowered vertically, to be tilted at a negative angle from the horizontal to suit an operator, and to be locked in a selected attitude.

Still another object of the invention is to provide a keyboard support system that can be easily and conveniently installed to a conventional computer desk and provide a horizontally and vertically movable and tiltable keyboard support that can maintain a mouse pad extending from either side of the keyboard support, at keyboard height, and can be tilted from the horizontal, as well as a vertically adjustable document holder.

Still another object of the invention is to provide a keyboard support system where the individual components, less connectors, are suitable for manufacture from a hard plastic material, such as an ABS plastic.

The computer keyboard support system of the invention includes a track, that is preferably a double track with parallel upper and lower tracks and is arranged for mounting onto an undersurface of a computer table, or the like. An articulating arm of the invention is arranged to travel in the lower track and mounts a keyboard holder, support or platform on a lower end. So arranged, the keyboard holder or support can be moved horizontally and vertically with respect to the computer table and can be tilted, at a negative angle from the horizontal of up to nine (9) degrees, with the articulating arm arranged to be locked in a selected position. Articulating arm functioning allows an operator to set the keyboard holder or support whereon a computer keyboard is arranged to a desired height and angle to the horizontal that is preferably a wrist neutral keyboard attitude for the particular operator working at the computer keyboard.

Further, for supporting the operators palms so as to minimize operator fatigue and protect the operator against carpal tunnel syndrome, or the like, the keyboard holder or support, along a forward top edge, includes a palm rest that is vertically adjustable and may be padded across a top surface. Also, a flat platform or plate of the keyboard holder or support, that supports the computer keyboard, is arranged to be horizontally moveable relative to the keyboard holder, allowing the operator to move the flat platform or plate horizontally to adjust spacing of a computer keyboard maintained thereon relative to the operator. Additionally, the invention preferably includes a mouse pad that is arranged for mounting to either side of the keyboard holder or support, so as to extend horizontally therefrom the keyboard height. Additionally, the mouse pad includes a bracket for mounting onto a track arranged across a mouse pad top section to provide a capability for adjusting the horizontal positioning of the top section, and a pivotal mounting of a coupling foot to a bracket face is provided to afford the mouse pad of the invention with a capability for tilting the top surface from the horizontal.

The mouse pad, as provided for mounting to extend outwardly from either side of the keyboard holder or support, can be arranged for mounting onto the end of the articulating arm, to replace the keyboard holder or support. Further, a document holder is preferably included with the invention arranged to be fitted into the upper track of the double track that is suspended from the computer table. Alternatively, the document holder may be arranged to be free standing, and is preferably configured to be vertically adjustable.

THE DRAWINGS

The following drawings illustrate that which is presently regarded as the best modes for carrying out the invention:

Figure 2:
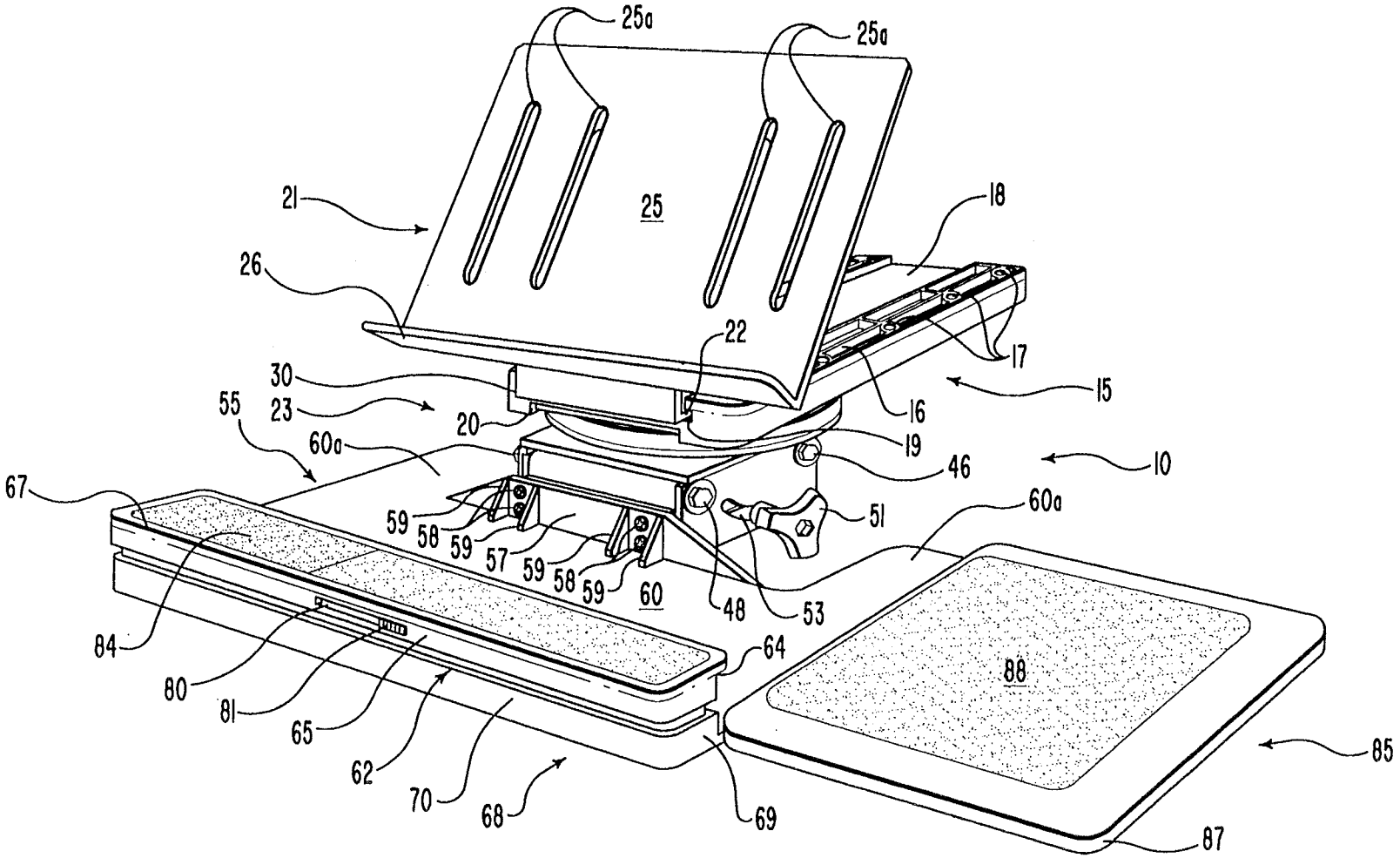
FIG. 2 is an enlarged view of the computer keyboard support system of the invention shown removed from the computer desk.
Figure 4:
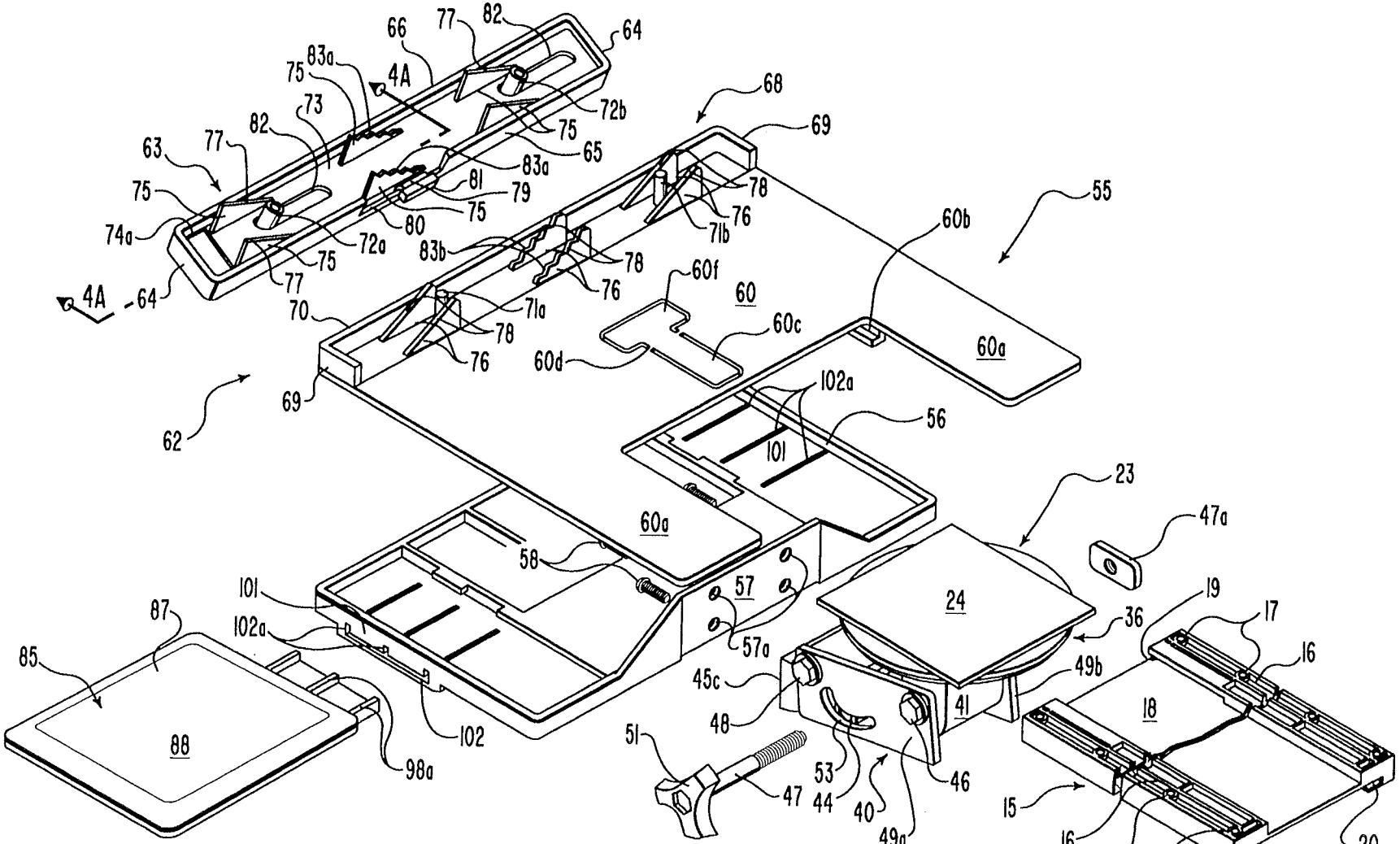
FIG. 4 is an exploded view of the computer keyboard support system of FIG. 2, less a document holder, showing a palm rest top section rotated one hundred eighty (180) degrees from its mounting along an edge of a plate and showing the plate for maintaining a computer keyboard thereon, mounted on tracks to a base to be positionable from front to back of the keyboard holder or support.
Figures 6, 6A:
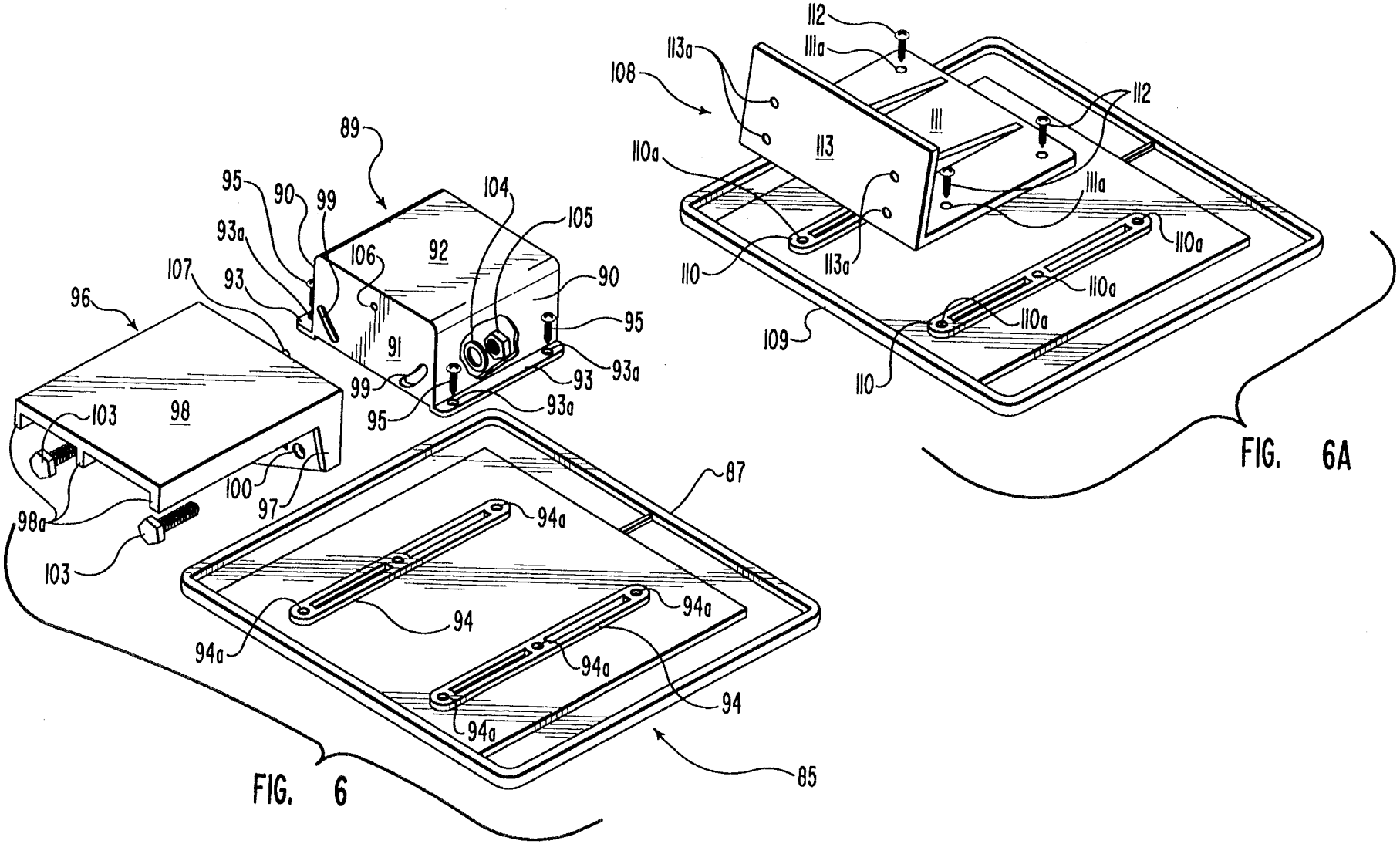
Figure 7A:
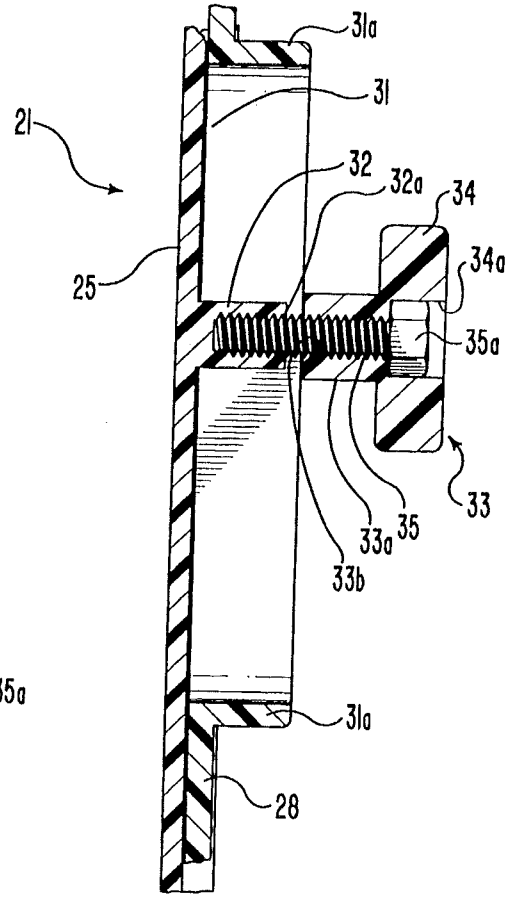
Figure 7:
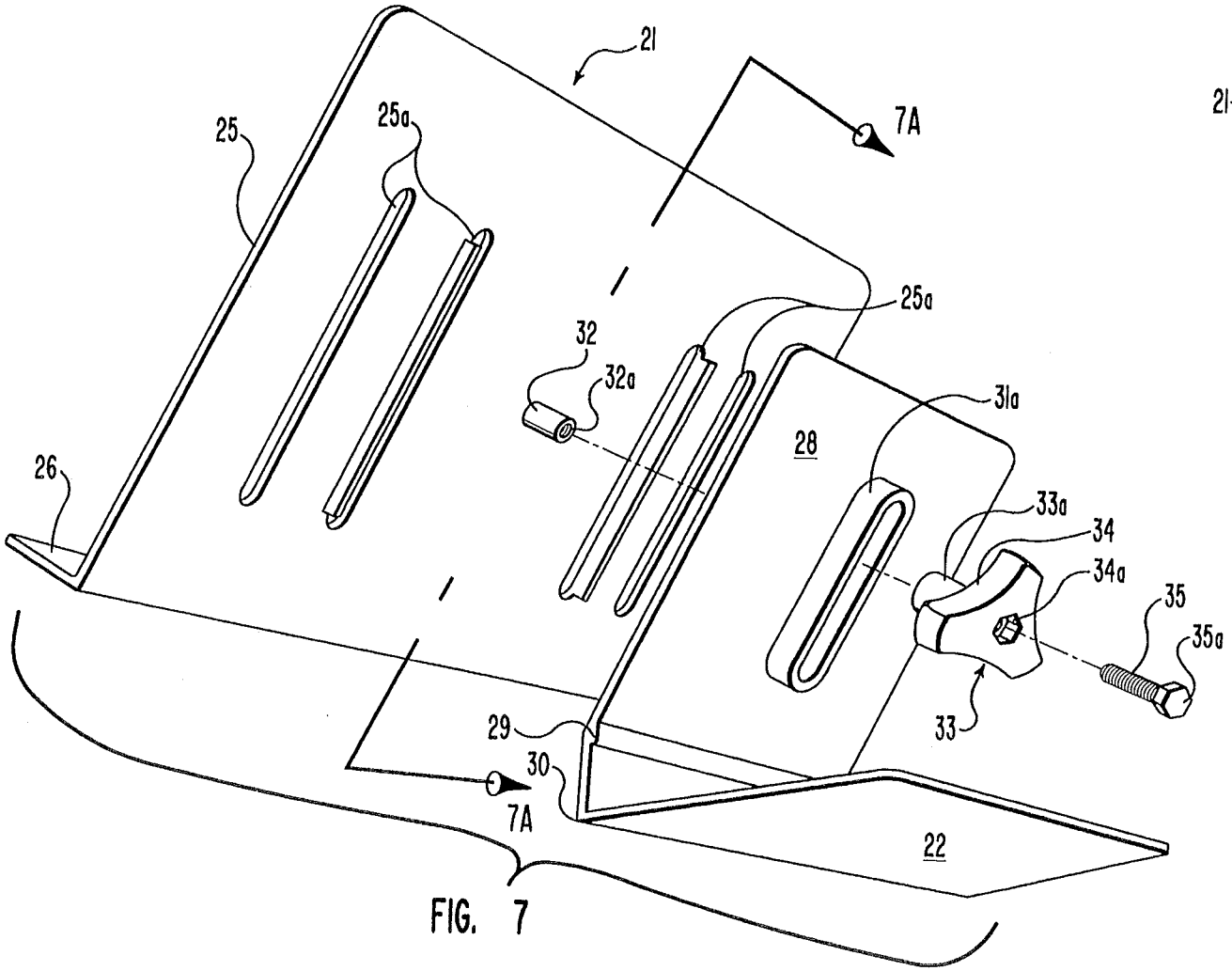

FIG. 6 is an exploded bottom plan perspective view of a mouse pad with a mount shown fitted onto parallel tracks that have been formed on the undersurface of a top section and showing a mounting foot arranged for pivotal connection to the mount to extend therefrom that is for fitting into a slot formed in the base of the keyboard holder or support, shown in FIG. 4, to provide for tilting the mouse pad top surface from the horizontal;

FIG. 6A is an exploded bottom plan perspective view like that of FIG. 6, only showing an articulating arm mount for securing to the mouse pad undersurface tracks and to the articulating arm as a replacement for the keyboard holder or support;

FIG. 7 is an enlarged exploded perspective view taken from the backside of the document holder of FIG. 2, showing a track and lock arrangement for adjusting vertical positioning of a document holder support portion along a mount section; and FIG. 7A is an enlarged profile sectional view taken along the line 7A—7A of FIG. 7, showing the document holder support portion maintained to the mount section.

DETAILED DESCRIPTION

Figure 1:
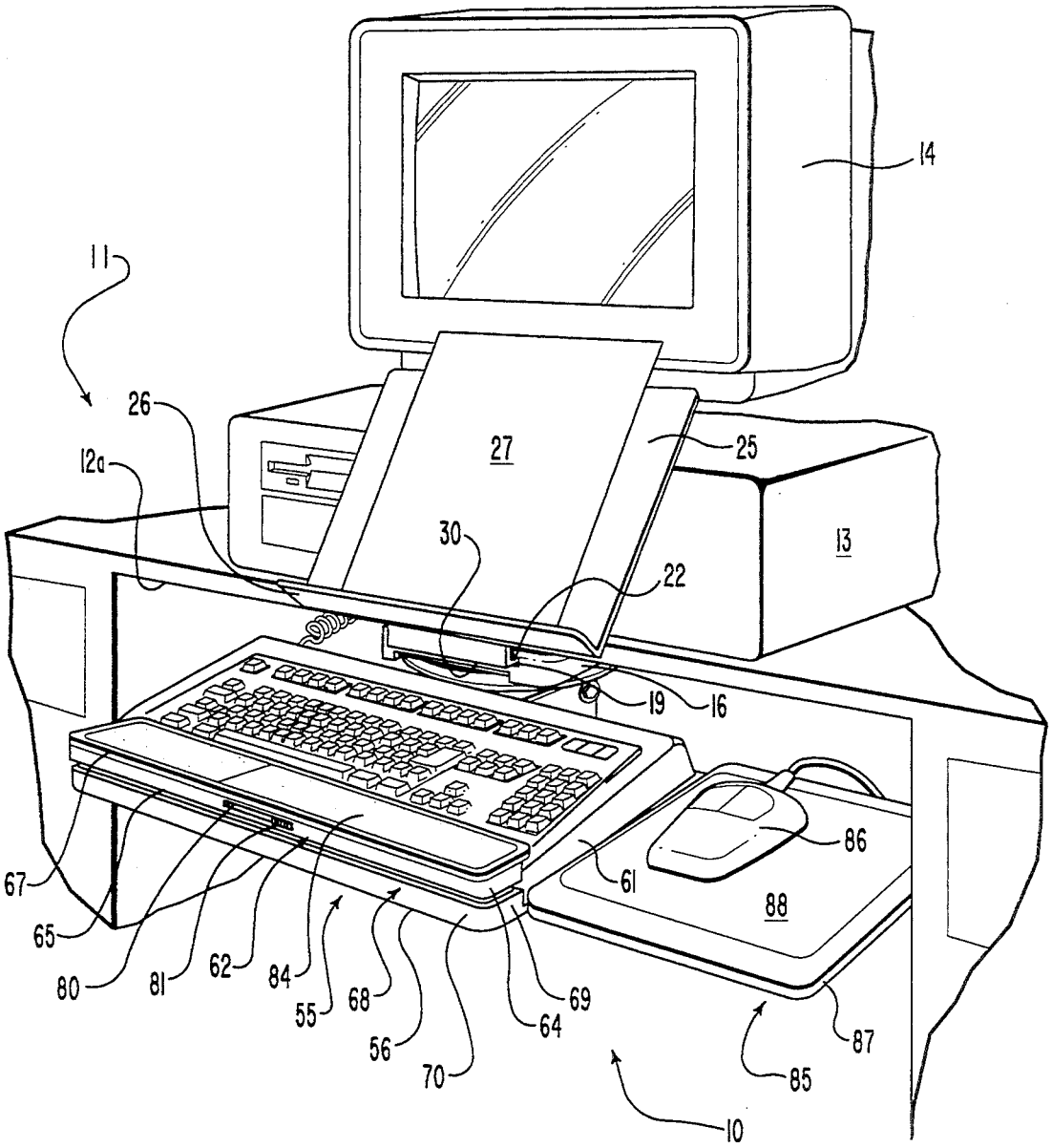
FIG. 1 is a front elevation perspective view, taken from a right side facing the invention, in a computer keyboard support system that is shown mounted to the undersurface of a section of a standard computer desk whereon a computer drive and monitor are positioned.

FIGS. 1, 2 and 4 show perspective and exploded views, respectively, of the invention in a computer keyboard support system 10, hereinafter referred to as support system. The support system, as shown in FIG. 1, is mounted to the undersurface 12*a* of a top 12 of a conventional computer desk 11, with computer table top 12, as shown in FIG. 1, supporting a conventional computer drive 13 and monitor 14 seated thereon.

Mounting of the support system 10 to the undersurface of table top 12, as shown best in FIGS. 2 and 4, is preferably provided by securing a double track 15, that is shown as having a flat rectangular shape, onto the undersurface 12*a* of the top 12 by fitting fasteners, such as screws, not shown, through holes 17 that have been formed through the double track side rails 16. The side rails 16 are parallel to one another and are separated by a flat rectangular web 18, with the rails including parallel inwardly facing upper and lower tracks 19 and 20, respectively, formed therealong, also shown in broken lines in FIG. 5A.

As shown in FIGS. 2, 7 and 7A, a slide 22 end portion of a mount section 28 of document holder 21 is fitted into the upper track 19 and a slide 24 of an articulating arm 23 is fitted into the lower track 20. Shown in the exploded view of FIG. 2A, and in FIGS. 3A and 3B, and best in FIGS. 7 and 7A, the document holder 21 preferably includes a flat forward section 25 that is outturned along a lower edge into a right angle ledge 26 that is for supporting a document 27, shown in FIG. 1, seated thereon. FIGS. 3A and 3B and 7 and 7A, show the flat forward section 25 maintained onto a thin flat forward face of mount section 28 that is bent at 29 to the vertical and includes a right angle bend 30 formed thereacross to form slide 22 of the mount section 28. The flat forward section 25 is preferably arranged to slide along the flat forward face of mount section 28 providing a height adjustment capability. To allow for this vertical movement and to provide for locking the components in place, a vertical slot 31, shown best in FIG. 7A, is formed in approximately the center of the mount section 28, that includes an outwardly projecting ridge 31*a* formed therearound. The slot 31 is for receiving a post 32 formed to extend at a right angle outwardly from approximately the center of the backside of the flat forward section 25. The post 32 is center holed and tapped at 32*a* and is for traveling within the slot 31 to provide a vertical adjustment capability to flat forward section 25. For maintaining or locking in place the relative positioning of the flat forward section 25 to the mount section 28, the post 32 threaded hole 32*a* receives a threaded end of a bolt 35 turned therein. The bolt 35, shown best in FIGS. 7 and 7A is for fitting through a head 34 and sleeve 33*a* of a lock nut 33 that is for manual turning. The lock nut 33, shown best in FIG. 7A, includes a longitudinal center passage 33*b*, that is preferably tapped, wherethrough the threaded end of bolt 35 is turned, seating the bolt in the lock nut 33. For further maintaining the bolt 35 in the lock nut 33, a hexagonal shaped bolt head end 35*a* is seated in a hexagonal sides cavity 34*a* that has been formed in the lock nut head 34, wherethrough the center passage 33*b* is formed.

In practice, for adjusting vertical positioning of the document holder 21 flat forward section 25 relative to the mount section 28, the lock nut 33 is manually loosened by turning the bolt 35 out of the sleeve 32 threaded center hole 32*a*. The positioning of the flat forward section 25 is adjusted manually, with the sleeve 32 sliding along the edges of the mount section slot 31. At a selected position, the lock nut 33 is turned by an operator grasping the lock nut head 34 and turning the bolt 35 in the sleeve tapped center hole 32*a* so as to clamp the lock nut sleeve 32 forward end against the top edge of the slot 31 outwardly projecting ridge 31*a*, clamping the mount section 28 forward face against the rear face of the flat forward section 25, so as to maintain the sections together until released. For determining the positioning of the flat forward section 25 along the mount section 28, one or more vertical slots 25*a* can be formed in the flat forward section for viewing the positioning of the mount section 28 therethrough.

Figure 5:
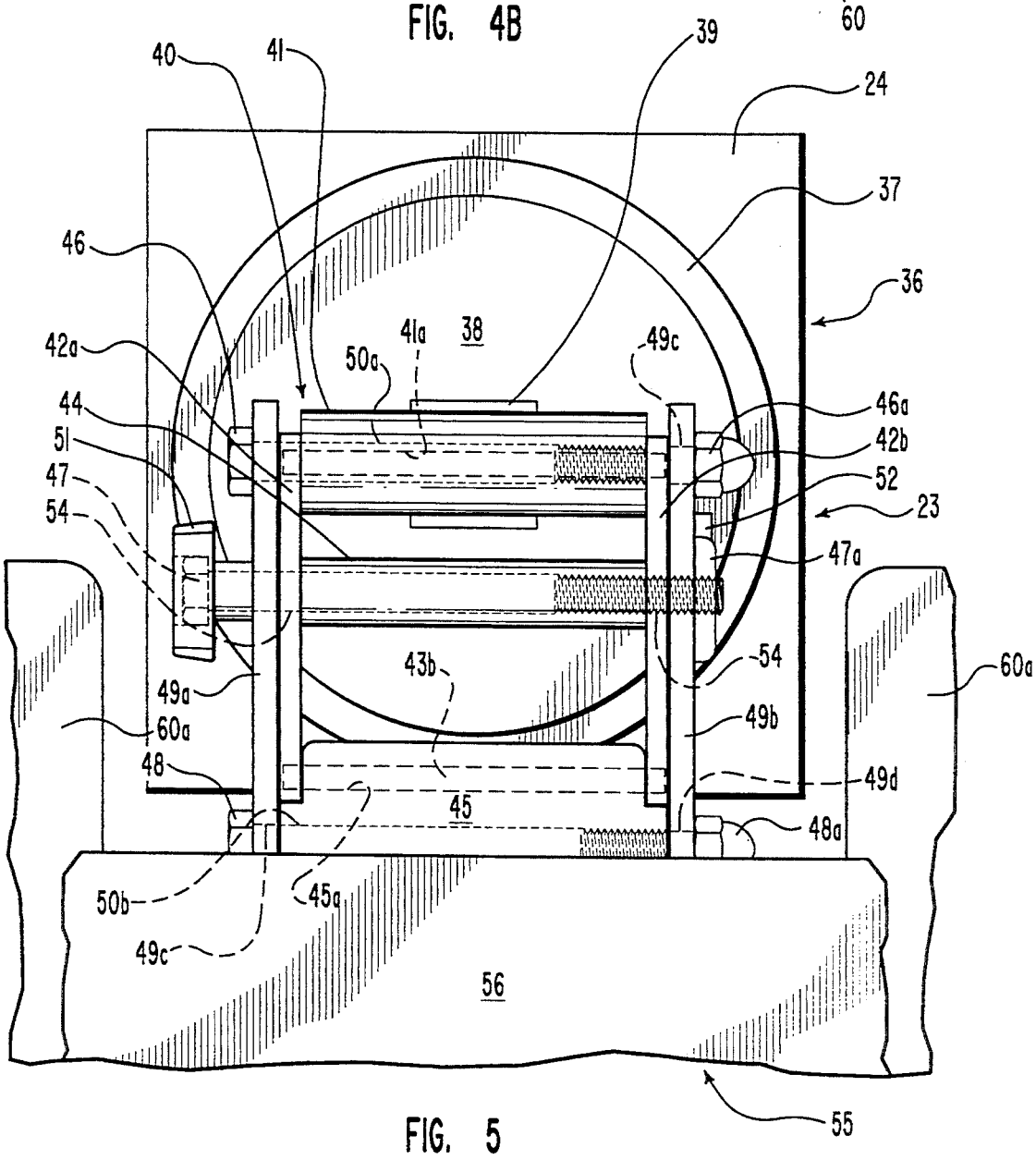
FIG. 5 is an enlarged bottom plan view of the articulating arm of the computer keyboard support system.
Figure 5A:
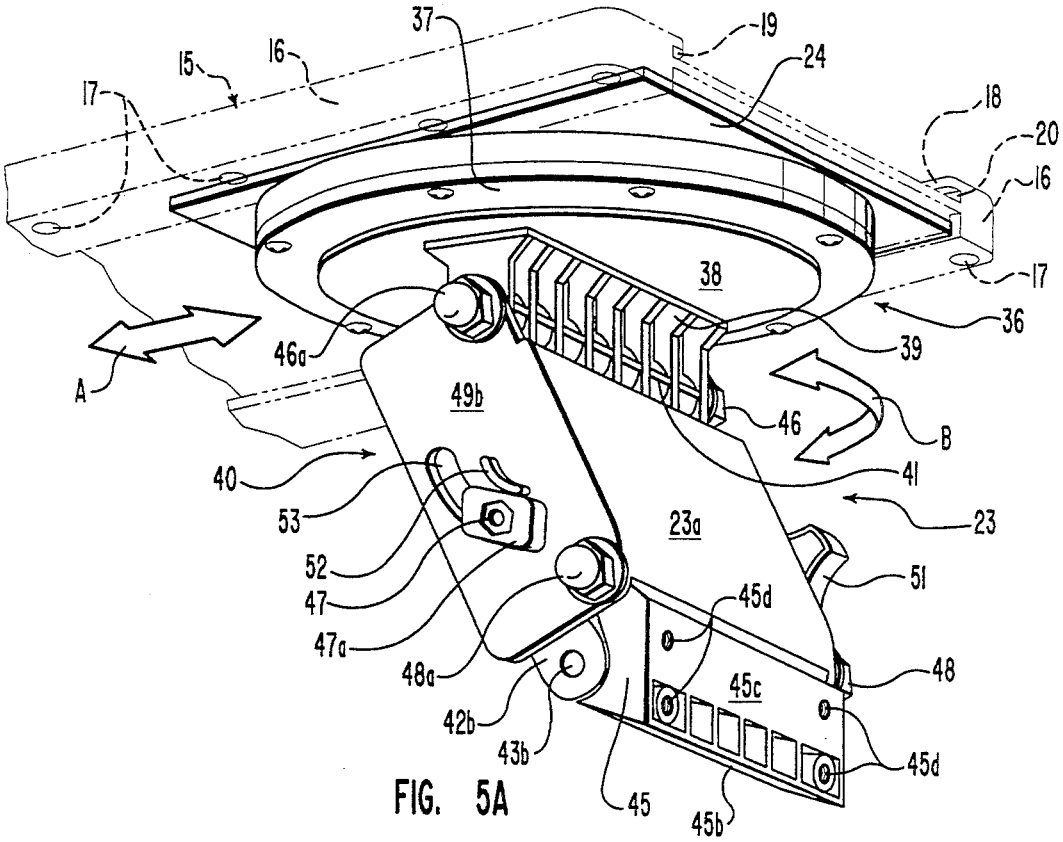
FIG. 5A is a reduced profile perspective view of the articulating arm of FIG. 5 showing, with arrows, the head or top end of the articulating arm as having been moved along a track, shown in broken lines, and is shown pulled down, away from the track, so as to move a connected keyboard holder mount vertically.

As described above, the lower track 20 of the double track 15 is for receiving the articulating arm slide 24, fitted therein, spanning the double track web 18 which slide 24 is shown in FIG. 4 and in broken lines in FIG. 5A as a square narrow flat section. The slide 24 is, in turn, arranged as a top portion of a round plate 37 of an articulating arm head 36, as shown also in FIGS. 3A and 3B, and is secured across a top surface thereof as part of the articulating arm 23. A pivot bracket mounting plate 38 is shown best in FIGS. 5 and 5A secured to the round plate 37 undersurface that includes a pivot bracket 39 extending downwardly from the plate 38 undersurface. A straight sleeve 41 is shown secured across the pivot bracket 39 that is arranged as one end of a pivoting frame 40 of the articulating arm 23.

The pivoting frame 40, as shown in FIGS. 5 and 5A, includes the sleeve 41 fitted between corners of lock sides 49*a* and 49*b*, with flat narrow rectangular shaped connecting links 42*a* and 42*b* maintained across and parallel to and in contact with lower sides of lock sides 49*a* and 49*b*. Which connecting links 42*a* and 42*b* are themselves parallel, and include pivot pins 43*a* and 43*b*, shown in broken lines in FIG. 5, with solid pivot pin 43*b* shown in FIG. 5A, extending therebetween. The pivot pins are fitted, respectively, through a link passage 41*a* formed across sleeve 41 and a link passage 45*a* formed across a keyboard holder bracket 45. Which sleeve 41 is maintained across the lock sides 49*a* and 49*b*, at rear corners thereof, as shown in FIGS. 3A, 3B, 5 and 5A, by fitting a bolt 46 through lock sides corner holes 49*c*, with a nut 46*a* for turning thereover. For which pivot coupling, the bolt 46 is fitted through a pivot hole 50*a*, shown in broken lines in FIG. 5, formed across the sleeve 41, parallel to link passage 41*a*, as set out below. Also included with the pivoting frame 40 is a center cylinder 44 that is shown maintained between the lock sides 49*a* and 49*b* and the links 42*a* and 42*b*, at approximately the link centers. The center cylinder 44 is arranged parallel to sleeve 41, and receives a locking bolt 47 fitted therethrough whereon is turned a nut 47*a*, as discussed in detail hereinbelow.

Additional to the link passage 45*a* formed across the keyboard holder bracket 45, the bracket includes a pivot hole 50*b*, shown in broken lines in FIG. 5, formed thereacross, parallel to the link passage 45*a*, and spaced apart therefrom for receiving a bolt 48 fitted therethrough that passes through corner holes 49*d*, shown in broken lines in FIG. 5, formed through the lock sides 42*a* and 42*b*, with nut 48*a* turned thereover. Which keyboard holder bracket 45 and bolt 48 are the pivoting end of the rectangular frame 40. The keyboard holder bracket 45, as set out hereinbelow, is for receiving a keyboard holder 55 mounted thereto. The rectangular frame 40 is thereby mounted at sleeve 41 onto the articulating arm head 36 and at keyboard holder bracket 45 to keyboard holder 55. Also, to conceal its inner workings, a cover 23*a*, as shown in FIG. 5A, may be included thereover.

To provide a rigid coupling of the articulating arm 23 components, the lock sides 49*a* and 49*b* are arranged to be urged towards one other, clamping against the respective sleeve 41 and keyboard holder bracket 45 ends and pulling the lock sides against the links 42*a* and 42*b*. Which links are, in turn, biased against the opposite ends of center cylinder 44, thereby locking the components together. For providing a releasable locking, the nuts 46*a* and 48*a* are turned on the bolt 46 and 48 ends to where there is a snug engagement of the lock sides 49*a* and 49*b* edges around holes 49*c* and 49*d*, formed therethrough, providing a resistance to the articulating arm 23 being moved from the attitude shown in FIG. 3A to the attitude shown in FIG. 3B. Which articulating arm 23, when positioned at a desired attitude, is maintained in that attitude by a tightening of the bolt 47 in nut 47*a*, clamping the lock sides 49*a* and 49*b* against the links 42*a* and 42*b* that, in turn, clamp against the ends of center cylinder 44.

Figure 3A:
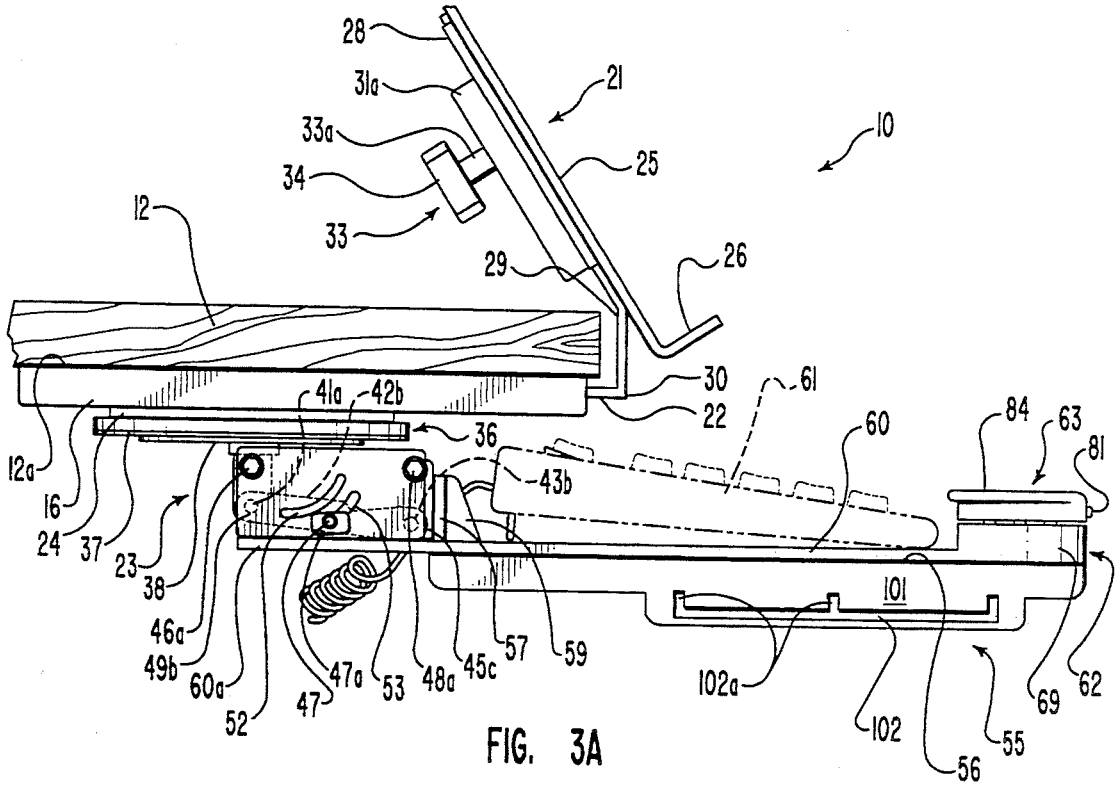
FIG. 3A is an expanded left side elevation view of the computer keyboard support system of FIG. 1.
Figure 3B:
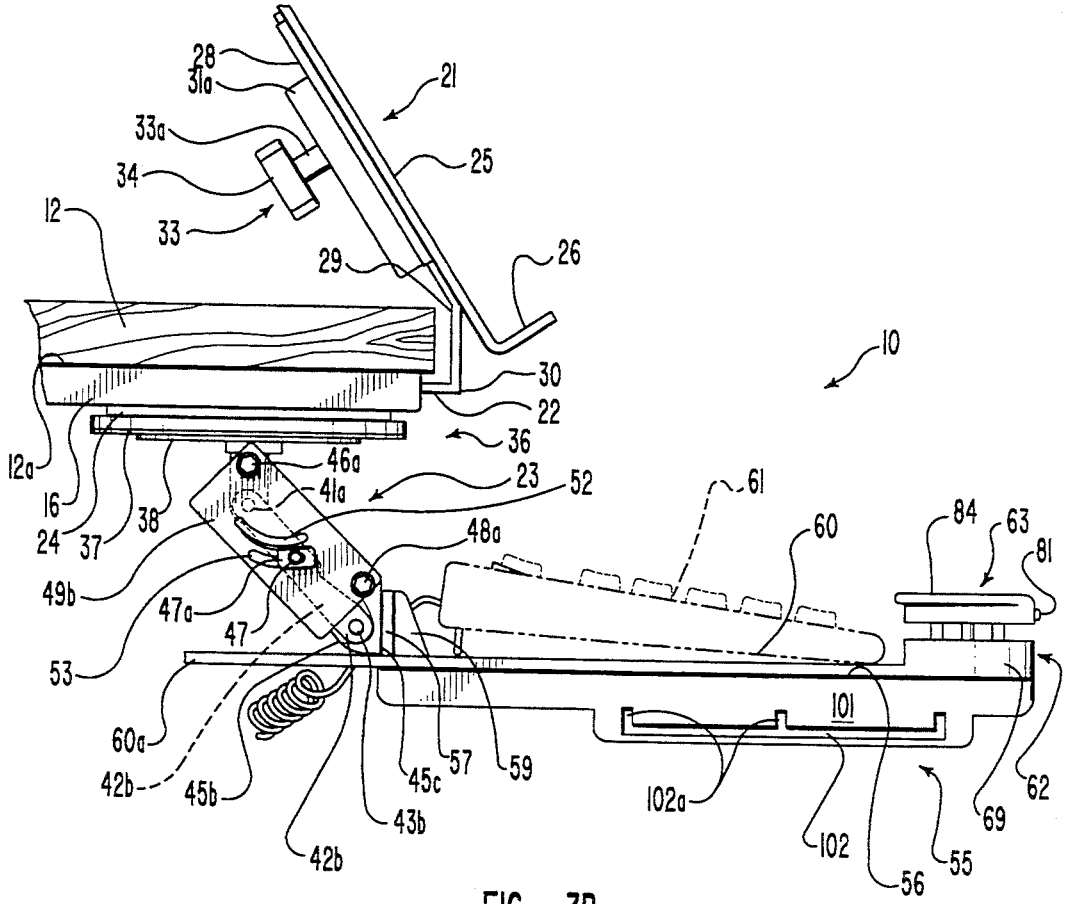
FIG. 3B is a view like FIG. 3A only showing a keyboard holder or support thereof lowered by operation of an articulating arm, and showing a palm rest portion of the keyboard holder or support in an erected attitude.

The keyboard holder bracket 45, as shown best in FIGS. 3B and 5A, includes a curved surface 45*b* across the bracket side that is opposite to the pivot coupling provided by bolt 48*a* to be maintained between lock sides 49*a* and 49*b* and adjacent to link passage 45*a*. The keyboard holder bracket 45 curved face 45*b* allows the keyboard holder bracket to pivot between the attitudes shown in FIGS. 3A and 3B, with the link 42*b* end and pivot pin 43*b* end shown exposed in FIGS. 3B and 5A. In FIGS. 3A, 3B and 5A, a flat forward face 45*c* of the keyboard holder bracket 45 is shown as being essentially vertical such that the keyboard holder 55 that is connected at a right angle thereto will be essentially horizontal. By pivoting the keyboard holder bracket 45 shown in FIGS. 3B and 5A back into its recessed attitude shown in FIG. 3A, the flat forward face 45*c* is tilted from the vertical up to nine (9) degrees. The tilt of keyboard holder bracket 45, in turn, sets the keyboard holder 55 at up to a nine (9) degree negative angle from the horizontal. Such positioning capability of the keyboard holder 55 provides for positioning of a computer keyboard 61 at a desired angle for operator comfort and convenience. The negative tilt of the keyboard holder 55, as set from the horizontal, is maintained, as described above, by a turning of the bolt 47 in nut 47*a* so as to clamp the lock sides 49*a* and 49*b* against links 42*a* and 42*b* and against the ends of the respective sleeve 41 center cylinder 44 and sides of the keyboard holder bracket 45.

To facilitate turning of bolt 47 in nut 47*a*, bolt 47 is preferably provided with an end head 51 that as shown in FIG. 4, is preferably formed as a three pointed star.

The preferred star configuration is to provide a gripping surface for engagement by an operator's hand. To provide for holding nut 47*a*, that is shown in FIGS. 3A, 3B, 5 and 5A, as a flat rectangular section with a threaded hole formed therethrough, or may include a separate nut mounted therein, not shown, while the bolt 47 threaded end is turned therein, a stop 52, that is shown as a curved section, is arranged to project outwardly from the lock side 49*b*, as shown in FIGS. 3A and 3B and best in FIG. 5A. Stop 52 provides an edge for engaging a long side of the nut 47*a* so as to hold it in place as the bolt 47 is turned. The bolt 47, nut 47*a* and the center cylinder 44 through which bolt 47 is fitted are arranged to slide in and along aligned arcuate openings 53 that are formed through the lock sides 49*a* and 49*b*, respectively, as shown in FIGS. 3A, 3B and 5A, and pass through holes 54 formed in the links 42*a* and 42*b*, shown in broken lines in FIG. 5, and pass through the center cylinder 44. With the bolt 47 fitted through link holes 54 the articulating arm 23 is locked in place by turning the bolt 47 end head 51, as set out below.

In practice, as set out above, the lock sides 49*a* and 49*b* are urged towards one another so as to clamp the links 42*a* and 42*b* against the ends of the center cylinder 44 by a tightening of nut 47*a* on the threaded end of bolt 47, such tightening of nut 47 on a bolt 47, in turn, provide for clamping the lock sides 49*a* and 49*b* against the link 42*a* and 42*b* ends that are, in turn, clamped against the ends of sleeve 41 and keyboard holder bracket 45, restricting travel of the articulating arm 23 between the attitudes shown in FIGS. 3A and 3B, a the tilting of the keyboard holder bracket 45 up to a negative angle of up to nine (9) degrees from the horizontal. Absent the application of the clamping force applied by turning the bolt 47 in nut 47*a*, articulating arm 23 movement is allowed between the attitudes shown in FIGS. 3A and 3*b*, and the keyboard holder bracket 45 is allowed to be pivoted so as to set the connected keyboard holder 55 at a desired negative angle from the horizontal. Whereafter, by turning the bolt 47 into the nut 47*a*, a further clamping force is applied to lock the articulating arm 23 components in place.

The above described structure and operation of the articulating arm 23 provides for raising or lowering of the connected keyboard holder 55, to the attitudes shown in FIGS. 3A, 3B, 5 and 5A. With a tilting of the keyboard holder 55 at a negative angle of up to nine (9) degrees from the horizontal provided, as describe above. So arranged the keyboard holder bracket 55 forward face 45*c* is moved out from and back to between the lock sides 49*a* and 49*b* ends, as shown in FIGS. 3B and 5A, providing a desired angle from the vertical thereto of up to a nine (9) degrees. Which angle is translated to a negative angle from the horizontal to the connected keyboard holder 55.

Shown in FIGS. 3B and 4, a mounting plate 57 of a keyboard holder base 56 of the keyboard holder 55 is for fitting onto the bracket forward face 45*c*. The mounting plate 57 includes holes 57*a* formed therethrough for aligning with threaded holes 45*d* formed in the bracket forward face 45*c*, as shown best in FIG. 5A. The threaded holes 45*d* are to receive fasteners, shown as bolts 58, that are fitted and turned therein, to maintain keyboard holder base 56 to the keyboard holder bracket 45.

Figure 4A:
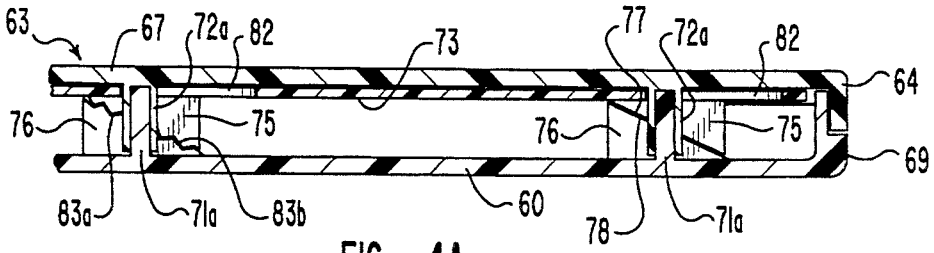
FIG. 4A is a sectional view taken along the line 4A—4A of FIG. 4, showing a profile sectional view of the palm rest and its erection mechanism of the invention, the palm rest shown in a lowered attitude.
Figure 4B:
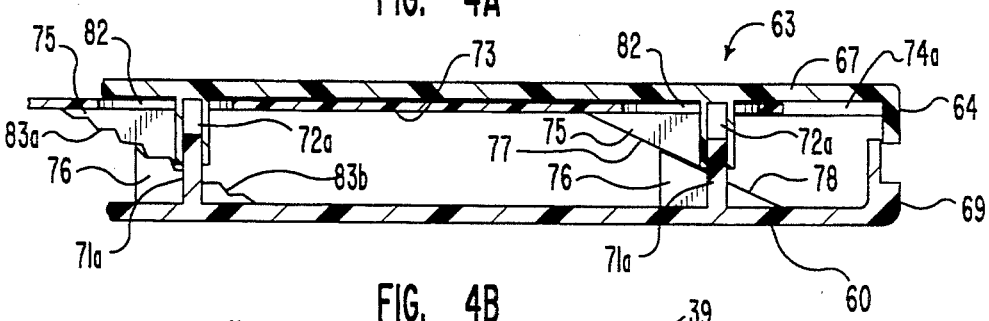
FIG. 4B is a sectional view like FIGS. 4A taken along the line 4A—4A of FIG. 4, only showing the palm rest in an erected attitude.
Figure 4C:
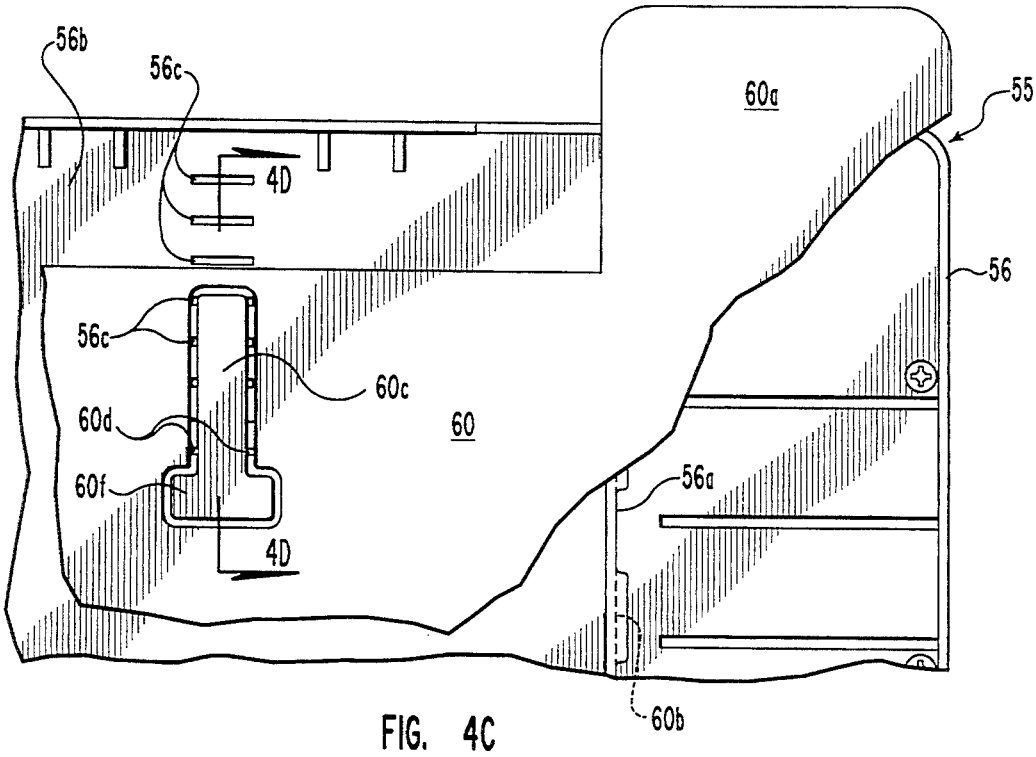
FIG. 4C shows an enlarged section of the keyboard holder plate and base of FIG. 4, showing a pivoting arm that is formed in the plate to pivot an end thereof into one of a number of spaced slots formed in the base, with the plate shown mounted on rails to the base.

The keyboard holder 55 base 56 is arranged to mount a flat plate or platform 60 thereon. To provide which mounting the platform 60 preferably includes a pair of parallel rails 60*b* that extend downwardly and hook inwardly, as shown in FIG. 4 and 4C, to hook under and slide along each of a pair of parallel tracks 56*a*, that are shown in FIG. 4C, extending across base 56, from front to rear. The platform 60 is thereby arranged to be positionable towards or away from an operator sitting in front of a computer keyboard 61 maintained thereon. Which platform 60 is preferably a flat rectangular section wherefrom a section has been removed at a center portion of a rear or back edge to leave wing sections 60*a*. The wing sections 60*a*, with the platform 60 mounted onto the keyboard holder base 56, are to extend alongside the articulating arm 23.

Figure 4D:
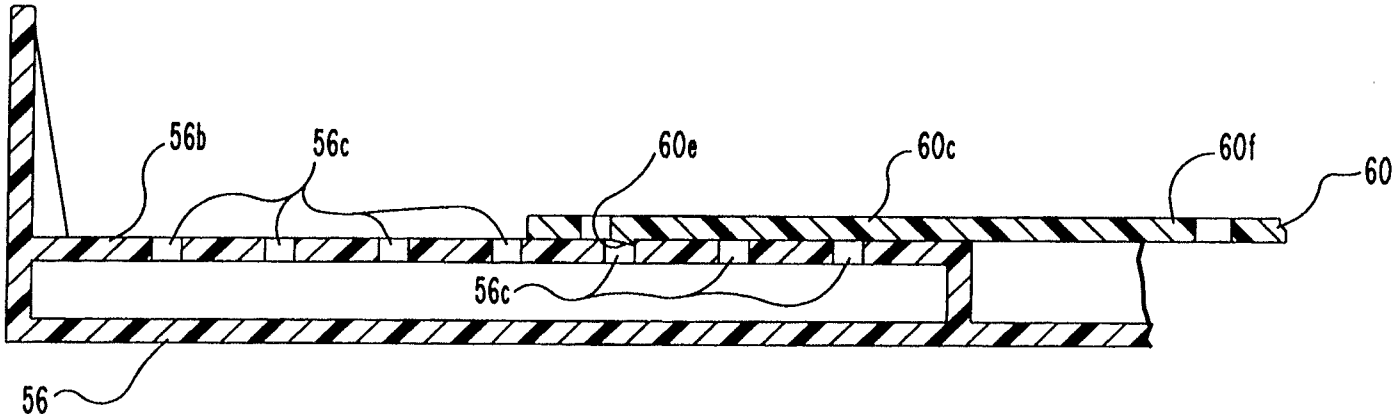
FIG. 4D is a side elevation sectional view taken along the line 4D—4D of FIG. 4C, showing a tooth section formed across the pivoting arm end fitted into one of the spaced slots.
Figure 4E:
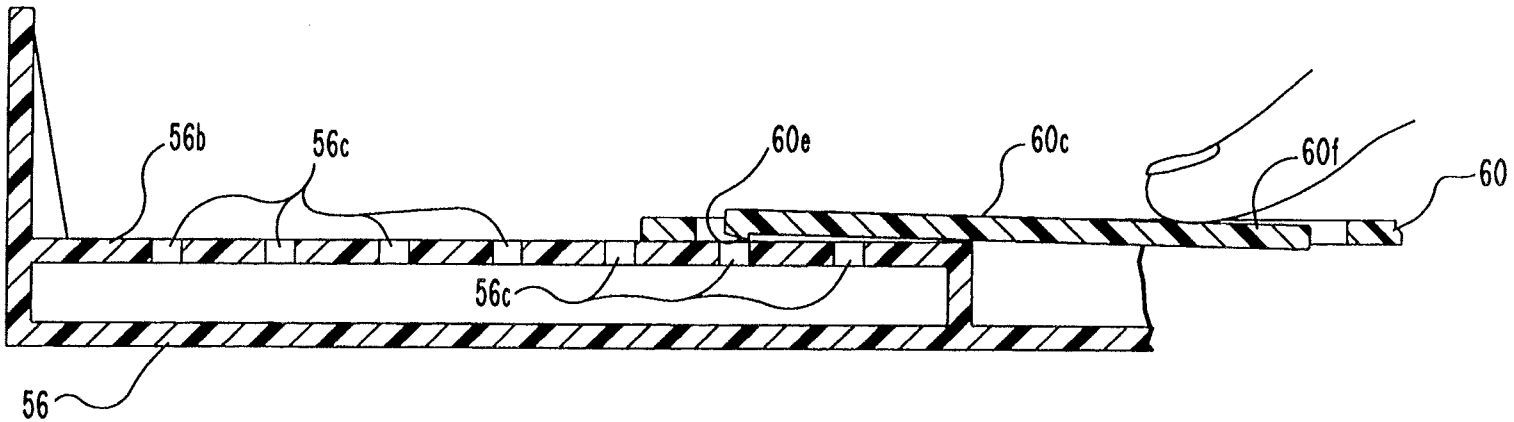
FIG. 4E is a view like FIG. 4D except an operators finger is shown depressing the pivoting arm end opposite to the tooth section end, thereby lifting the tooth section out of the spaced slot.

The platform 60, as set out above, is fitted onto the base 56 so as to be movable back and forth thereon. To lock the platform to the base an arm 60*c* is formed in the platform 60 surface as by cutting an appropriate slot therearound to leave a pair of pivots 60*d* arranged across from each other, connecting the arm 60*c* in the platform 60. The arm 60*c*, shown in FIGS. 4, 4D and 4E, is formed such that, when a broad end thereof is manually depressed, the arm 60*c* narrow end will be elevated to lift a tooth ridge 60*e* formed across the narrow end upwardly, as shown best in FIGS. 4D and 4E. The tooth ridge 60*e* extends across an undersurface of a leading edge of the arm 60*e* narrow end is formed to fit into one of a number of spaced parallel slots 56*c* that are formed from front to rear in a top section 56*b* of the base 56. So arranged, by depressing the arm 60*c* broad end 60*f*, as illustrated in FIG. 4E as by an operator depressing the broad end with their finger, the tooth ridge 60*e* will be elevated out of one of the slots 56*c*, allowing the platform 60 to be moved along the parallel tracks 56*a*, towards or away from an operator seated in front of the computer keyboard 61.

A travel limit of the platform 60 away from an operator is provided, as shown in FIG. 2, by engagement of the platform edge between the wing sections 60*a* with a forward face of the keyboard holder bracket 57. That platform edge to fit beneath parallel straight outstanding legs of each of two pairs of aligned spaced tabs 59. The tabs 59 are shown to be formed as right triangle sections mounted along their respective bases to the keyboard holder bracket 57. The platform 60 is thereby releasably maintained along its rear edge between arm sections 60*a* to the keyboard holder bracket 57 forward face.

As set out above, the flat platform 60 is for supporting a computer keyboard 61 thereon, shown in FIG. 1, and in broken lines in FIGS. 3A and 3B. Further, the platform 60 preferably includes a palm rest 62 that is arranged across its forward edge, shown also in FIGS. 2 and 4, with the preferred mechanism for raising and lowering which palm rest shown in FIGS. 4A and 4B. The palm rest 62 is to provide a rest for an operator to maintain their palms on as they work at computer keyboard 61. The palm rest 62 is provided as an aid for protecting the computer operator from experiencing corporal tunnel syndrome, or a like malady, as could be associated with an operator's work at a computer keyboard.

The palm rest 62, as set out above, is preferably height adjustable. As shown best in FIGS. 4, 4A and 4B, the palm rest includes a top portion or section 63, that is preferably formed as a narrow rectangular box having short equal length side, front, and rear walls 64, 65 and 66, respectively, and includes a flat top 67 connected therebetween. The top section 63 is open across its bottom area. The top section walls 64, 65 and 66, have edges that are planar and are sized to just slide by a top edge of a fence 68 that is formed across a forward edge of the platform 60. The fence 68, as shown best in FIG. 4, includes short equal length side and forward walls 69 and 70, respectively, that have a continuous top edge. As shown, the inner surfaces of the top section 63 side and forward walls 64 and 65 edges, respectively, are arranged to just slide along the outer surfaces of the fence 68 side and forward walls 69 and 70, with the palm rest in its lowest position, as shown best in FIG. 4B.

For guiding the top section 63 vertical travel, a pair of spaced apart cylindrical pins 71*a* and 71*b* are arranged to extend at right angles upwardly from the platform 60 forward edge, within the fence 68, and are aligned to fit and travel within each of a pair of cylinders 72*a* and 72*b* that extend at right angles from the undersurface of the top section 63 flat top 67. So arranged, up and down travel of the palm rest 62, to provide for height adjustability relative to the fence 68, is guided by the travel of pins 71*a* and 71*b* within the cylinders 72*a* and 72*b*, respectively.

Vertical travel of the palm rest 62 top section 63 relative to the fence 68 is provided by travel of a rectangular plate 73 that has opposite parallel long edges arranged in aligned parallel grooves 74*a* that are formed in the palm rest front and rear walls 65 and 66, respectively, as shown in FIG. 4. The plate 73 includes spaced apart pairs of right triangle sections 75 that oppose like spaced apart pairs of right triangle sections 76 that extend at right angles upwardly from the platform 60 forward edge, within fence 68, as shown in FIGS. 4, 4A and 4B. So arranged, the respective right triangle sections 75 and 76 have opposing hypotenuse sides 77 and 78, respectively, that will slide along one another when the plate 73 is moved along grooves 74*a*, thereby lifting or lowering the top section 63. An arm 79, as shown best in FIG. 4, is connected to extend outwardly from the side of plate 73 to fit through a longitudinal slot 80 that has been formed in the forward side wall 65. The arm 79 mounts, on its end opposite to its coupling to the side of plate 73, a finger engaging tab 81 that is to be engaged by an operator's finger.

The plate 73, as described above, is arranged to travel along the opposing grooves 74*a* so as to move the opposing hypotenuse surfaces 77 and 78 respectively of the right triangle sections 75 and 76 along one another. Which plate 73 movement is provided by an operator moving the finger engaging plate 81. After plate 73 movement to a desired vertical attitude, opposing teeth 83*a* and 83*b* that are formed along the opposing hypotenuse surfaces 77 and 78, respectively, of a center pair of the right triangle sections 75 and 76, respectively, are in meshing engagement, as shown in FIGS. 4, 4A and 4B. Such meshing engagement is enhanced by an application of the weight of an operator's palm resting on the palm rest top surface 67, and prohibits palm rest vertical movement. The opposing teeth 83*a* and 83*b* meshing engagement is overcome by removing weight off from the palm rest top surface and the operator moving the tab 81 with their finger. While opposing teeth 83*a* and 83*b* are shown herein as preferred for locking the palm rest 62 top section in a selected vertical attitude, it should be understood that other locking configurations could be so used within the scope of this disclosure.

Plate 73, as shown in FIG. 4 is provided with a pair of center longitudinal slots 82 wherethrough the cylinders 72*a* and 72*b* extend. So arranged, during travel of the opposing hypotenuse sides 77 and 78 of the right triangle sections 75 and 76, respectively, the opposite long sides of slots 82 will slide alongside of the cylinders 72*a* and 72*b*, with cylinder contact with the ends of slots 82 to limit further plate 73 travel. During palm rest 62 functioning, as set out above, the pins 71*a* and 71*b* telescope into the cylinders 72*a* and 72*b*, respectively, guiding vertical travel of the palm rest 62 top section 63. Optionally, for providing a biasing of the palm rest top section 63 away from the platform 60, a spring may be included with each of the cylinders 72*a* and 72*b* and pins 71*a* and 71*b*, not shown, to urge the palm rest 62 top section 63 upwardly, or to maintain the positioning of the finger engaging plate 81 in slot 80. Or another spring arrangement, such a coil spring fitted over each of the pins 71*a* and 71*b*, not shown, could be so used. Or, a leaf spring arranged to bias the teeth 83*a* and 83*b* together, not shown, could be so utilized within the scope of this disclosure. In practice, a cover 84, shown in FIGS. 1 through 3B, may be includes over the top surface 67 of the palm rest 62. The cover 84 may or may not be padded, and is for supporting an operators wrists resting thereon as the operator types at the computer keyboard 61.

The invention can additionally include a mouse pad 85, as shown in FIGS. 1, 2, 4 and 6, whereon a computer mouse 86, shown in FIG. 1, can be moved manually by an operator. A preferred arrangement for mounting the mouse pad to extend in a horizontal plane outwardly from either side of the keyboard holder 55, preferably at the height of the computer keyboard 61, is shown in FIGS. 1, 2, 4, and 6. In this arrangement, the mouse pad 85 preferably includes a flat narrow top plate 87 that has a flat top surface whereto a sheet of a friction material is fixed as surface 88. The particular surface 88 is selected to provide a friction producing effect that is appropriate for operating a computer mouse thereon.

To provide for the mouse pad 85 mounting to the computer keyboard 61, as shown in FIG. 6, a box frame 89 is included that includes a pair of upstanding parallel sides 90, with a forward plate 91 extending at right angles from a box frame flat bottom 92, and between the ends of sides 90. The parallel sides 90 are each bent outwardly at right angles along their lower edges into flanges 93 that includes at least a pair of spaced holes 93*a* formed therethrough. The flanges 93 are to align with to slide along rails 94 that are formed across the undersurface of top plate 87. Which rails each include a plurality of space apart holes 94*a* formed therein. In practice, for mounting the box frame 89 onto the undersurface of the top plate 87, the box frame flanges 93 holes 93*a* are aligned with selected holes 94*a* formed into rails 94 and screws 95 are turned therein. This mounting provides a capability for connecting the mouse pad 85 onto the top plate 87 undersurface at a desired distance from the side of the computer keyboard, as set out hereinbelow.

A coupling foot 96 is preferably provided for connecting the box frame 89, generally before it is mounted onto the top plate 87, into the side of the keyboard holder 55. The coupling foot 96, to provide for connection to the box frame forward plate 91, includes a flange end 97 that is secured at a right across an end of a foot section 98. The foot section 98, as shown in FIGS. 3A, 3B and 4, and as set out herein below, is formed for coupling into a slot 102 that has been formed across either of end walls 101 of base 56, as opposite sides of the keyboard holder 55. Which coupling involves the foot section 98, that preferably includes spaced longitudinal ridges 98*a* for fitting into the slot 102 with spaced notches 102*a* formed in one or each of the side walls 101. In such fitting, the foot section 98 ridges 98*a* travel into and along notches 102*a* that have been formed at spaced intervals across a top edge of each slot 102. So arranged, the combination of foot section ridges 98*a* and slot 102 notches 102*a* provides for guiding and securely mounting the foot section 98 into either keyboard holder 55 base 56 side wall 101.

The coupling foot 96, as described above, can be rigidly mounted to the box frame forward plate 91. However, rather than a rigid mounting of the coupling foot 96 to the forward plate 91, a pivotal mounting is preferred to allow for setting and maintaining a desired tilt from the horizontal of the mouse pad 85 top plate 87. To provide such pivot mounting, as shown in FIG. 6, the coupling foot flange end 97 includes a pair of holes 100 that are formed therethrough that are for alignment with each of a pair of curved slots 99 that are formed through the box frame forward plate 91, to receive bolts 103 fitted therethrough, the bolts 103 are shown in FIG. 6 aligned from fitting through the respective holes 100 and slots 99, and are each aligned to receive a washer 104 and nut 105 fitted and turned thereover, for clamping the coupling foot 96 onto the forward plate 91 of the box frame 89. Prior to which clamping together, the coupling foot is positioned in a desired tilt attitude on the surface of the forward plate 91, which tilt attitude is limited by the travel of the bolts 103 from end to end of the curved slots 99. Further, to facilitate coupling foot 96 positioning, a hole 106 is formed in approximately the center proximate to the junction of the forward plate 91 and box frame bottom 92 that is to receive a pin 107 that extends at a right angle outwardly from the opposing surface of the coupling foot flange end 97. The pin 107 fitted into hole 106 to provide a pivot coupling therebetween.

The mouse pad 85 top surface 87 can thereby be set at an angle from the horizontal as limited by the lengths of the curved slots 99, which angle is preferably up to nine (9) degrees. At which selected angle the described nuts 105 are tightened on the threaded ends of bolts 103 to releasably couple the mouse pad 85 components together, and the coupling foot section 98 is fitted into the slot 102 of the right or left side wall 101 at base 56.

Additionally, another arrangement of a mouse pad 108, as shown in FIG. 6A, can be provided for mounting to keyboard holder bracket 45, as a substitution for the keyboard holder 55. Mouse pad 108 is like mouse pad 85 in that it includes of flat narrow top plate 109, whereon a friction producing surface is applied as a top surface, and includes spaced apart rails 110 formed across its undersurface. Which rails 110 include spaced holes 110*a* formed therein that are to receive screw type fasteners 112 turned therein. The screw type fasteners 112 are to fit through holes 111*a* formed through a flat section of a coupling bracket 111 and are turned into the rail holes 110*a* for joining the coupling bracket onto the top plate 107. For mounting to the forward face 45*c* of the keyboard holder bracket 45, the coupling bracket 111 includes a coupling bracket flat plate 113, that is formed at a right angle to the coupling bracket flat section, and wherethrough spaced holes 113*a* are formed. The spaced holes 113*a* are for receiving bolt type fasteners 58, or the like, fitted therethrough and turned into threaded holes 45*d*, as shown in FIGS. 4 and 5A, for coupling the coupling bracket flat plate 113 onto the keyboard holder forward face 45*c*. The mouse pad 108, mounted onto the keyboard holder bracket 45 forward face 45*c* of the articulating arm 23, as described it provides as a substitution for the described keyboard holder 55 and its mounting. The mouse pad 108 can receive a computer mouse seated thereon, that is like the computer mouse 86 shown in FIG. 1. In which arrangement, the articulating arm provides for setting the height and angle of the mouse pad top surface 109 relative to the top 12 of computer desk 11, as described above with respect to the keyboard holder 55.

While a preferred embodiment of my invention in a computer keyboard support system, its use and functioning has been shown and described herein, it should, however, be understood that the present disclosure is made by way of example only and that variations and changes to the invention are possible within the scope of this disclosure without departing from the subject matter coming within the scope of the following claims and a reasonable equivalency thereof, which claims 1 regard as my invention.

I claim:

1. A computer keyboard support system comprising, an articulating arm means with means for connecting said articulating arm means between a work surface and a computer accessory holder and is arranged to both lower vertically from said work surface and tilt from the horizontal said computer accessory holder and includes a body that incorporates a first pivoting section that includes a top plate for fitting into a mount that is secured to an undersurface of said work surface, said first pivoting section provides a coupling across a top end of a pair of spaced parallel straight lock sides with a first pivot coupling arranged across a pair of straight flat links that are individually pivotally coupled to top ends of said first pivot coupling, said first pivoting section mounted to an undersurface of said top plate, and including a second pivoting section that provides a coupling across a bottom end of said pair of spaced parallel lock sides with a second pivot coupling arranged across bottom ends of said links, and with a keyboard holder mount as said second pivoting section for connection to said accessory holder, and means for clamping said spaced parallel lock sides against said links and against ends of said first and second pivoting sections, forming a rigid structure, until released.

2. A computer keyboard support system as recited in claim 1, wherein the means for connecting the articulating arm means between the work surface and a computer accessory holder is a flat rectangular section that includes aligned spaced holes formed along opposite sides thereof for receiving fasteners to connect said mount onto the work surface undersurface, and includes a straight flat section spanning between said opposite sides, with at least one pair of aligned longitudinal slots, each slot formed is an opposing wall of each said opposite sides, alongside said flat section to receive opposing edges of the articulating arm top plate.

3. A computer keyboard support system as recited in claim 2, wherein the mount includes a second pair of aligned slots formed longitudinally the opposing walls of said opposite sides, alongside each of said first pair of slots and separated therefrom by the flat rectangular section; and further including a document holder means for maintaining written materials thereon that includes a document holder slide for sliding into said second pair of slots, that is bent back upon itself into an upper portion for supporting a holder section of said document holder.

4. A computer keyboard support system as recited in claim 3, wherein the holder section is a narrow flat rectangular section that is bent at approximately a ninety degree angle across a lower portion thereof into an outwardly extending lip for receiving and supporting written materials thereon; means for mounting said holder section to the document holder slide upper portion to provide for vertical movement of said holder section along said document holder slide upper portion; and means for releasably locking said holder section to said document holder slide upper portion.

5. A computer keyboard support system as recited in claim 4, wherein the means for mounting and providing for vertical movement of the holder section onto and along the document holder slide upper portion is a vertical slot formed through said document holder slide upper portion section, and a slide pin mounted to extend at a right angle outwardly from approximately the center of said holder section for fitting through said vertical slot, and a means for fitting to said slide pin for binding against edges of said vertical slot; and a center tapped hole is formed in a head end of said slide pin to receive a threaded end of a bolt as said means for fitting to said slide pin turned therein, and said bolt maintains a knob means for manual turning by an operator to turn said bolt, with, when said bolt is turned into said slide pin, a flat forward end of said knob means to engage said edges of said vertical slot as the means for releasably locking said holder section to said document holder slide upper portion.

6. A computer keyboard support system as recited in claim 5, further including, an outwardly projecting ridge formed around the vertical slot, from a rear face of the document holder slide upper portion, said ridge having a flat top edge for engaging the flat forward end of said knob means.

7. A computer keyboard support system as recited in claim 1, wherein the arrangement of the second pivoting section and the second pivot provide for pivotally connecting the pairs of links and lock sides so as to allow the keyboard holder mount to be tilted such that the computer accessory holder couples thereto at a center of a rear edge thereof, can be tilted up to nine (9) degrees negative or downwardly from the horizontal.

8. A computer keyboard support system as recited in claim 7, wherein the computer accessory holder is a computer keyboard holder that includes a flat platform for mounting onto a base of said computer keyboard holder for supporting a computer keyboard positioned thereon, and includes a palm rest means mounted to extend upwardly from along a top forward edge of said flat platform.

9. A computer keyboard support system as recited in claim 8, further including means for adjusting and maintaining a flat top surface of the palm rest at a desired height above the top surface of the flat platform.

10. A computer keyboard support system as recited in claim 9, wherein the palm rest means includes a top portion formed as a narrow rectangle with equal height parallel front, rear and side walls with the flat top surface arranged across the top edges of said walls, and is open across said walls lower edges; the flat platform includes a fence arranged at a right angle to and across the top of a forward edge to pass by inner surfaces of said palm rest means front and side walls when said palm rest means is moved to a lowered attitude; the means for adjusting and maintaining said palm rest means height relative to said top surface of said flat platform is a rectangular plate having opposing equal length narrow flat front and rear sides, with parallel grooves formed in the opposing inner surfaces of said top portion front and rear walls for receiving edges of said rectangular plate front and rear sides to slide therealong, and said flat platform and rectangular plate each include ramp means that oppose each other whereby movement of said rectangular plate outer edges along said top portion front and rear walls grooves moves sides of said ramp means over one another thereby moving said top portion vertically relative to said flat platform, and means for moving said rectangular plate outer edges along said opposing grooves.

11. A computer keyboard support system as recited in claim 10, wherein the ramp means are pairs of identical spaced right angle triangle sections each positioned alongside the other with the triangle section bases of opposing pairs secured to the flat platform and the rectangular plate, respectively, such that the hypotenuse sides of said pairs that extend from the rectangular plate slide along the hypotenuse sides of the pairs that are secured to the flat platform; the means for moving said rectangular plate outer edges along said opposing grooves is an arm that extends outwardly from a rectangular plate outer edge and through a horizontal slot that has been formed in the palm rest means top portion front wall, which said arm includes a finger engaging tab formed across said arm end; and means for releasably maintaining said opposing hypotenuse sides of the opposing pairs in engagement.

12. A computer keyboard support system as recited in claim 11, further including guide means for guiding vertical movement of the palm rest means top portion relative to the flat platform consisting of at least one cylinder secured across a bottom end thereof to extend at a right angle upwardly from the bottom face of the palm rest means top surface and a post for each said cylinder secured across a lower end at a right angle to the flat platform to fit through a longitudinal slot formed in the rectangular plate and to fit axially into said cylinder; and at least one center longitudinal slot formed in said rectangular plate wherethrough said cylinder extending from said bottom face of said palm rest is fitted, to slide freely along said longitudinal slot.

13. A computer keyboard support system as recited in claim 11, wherein the means for releasably maintaining the opposing hypotenuse sides of the opposing pairs of right angle triangle sections are teeth or serrations extending from along the opposing hypotenuse sides of at least one of the opposing pairs.

14. A computer keyboard support system as recited in claim 10, further including a layer of a padded material secured onto a top surface of said palm rest means top portion.

15. A computer keyboard support system as recited in claim 8, wherein the keyboard holder flat platform is arranged to be movable from front to rear across the base; means for guiding movement of said keyboard holder flat platform across said base that consists of at least a pair of opposing rails, the individual rails secured, respectively, to opposing surfaces of the keyboard holder flat platform and base; and releasably means for maintaining the relative positioning of said keyboard holder flat platform to said base.

16. A computer keyboard support system as recited in claim 8, further including a mouse pad means and means for mounting said mouse pad means to the keyboard holder whereby a mouse pad means flat top surface extends outwardly from a side of said keyboard holder.

17. A computer keyboard support system as recited in claim 16, wherein the mouse pad means, includes, as the means for mounting, a bracket secured to an undersurface of the flat top surface and means for coupling said bracket to a flat coupling foot; and the keyboard holder base includes at least one slot formed into a side thereof that is for receiving said flat coupling foot fitted therein as the means for mounting said mouse pad means.

18. A computer keyboard support system as recited in claim 17, wherein the bracket is positionable along rails arranged across an undersurface of the mouse pad means top surface and includes a flat mounting face for engaging a flange side of said flat coupling foot; means for pivot mounting an outer face of said flange side to said bracket flat mounting face so as to allow said flange side to pivot across said bracket flat mounting face to tilt the mouse pad means top surface.

19. A computer keyboard support system as recited in claim 18, wherein the means for pivot mounting includes a pair of spaced holes from through the coupling foot flange side, each hole to receive a bolt means fitted therethrough, and a pair of curved slots formed through the bracket flat mounting face to receive said bolt means fitted therethrough and nut means for turning onto said bolt means to clamp said flange side and flat mounting face surfaces together; and a pivot means consisting of post that extends outwardly from said flange side to fit into a hole formed in said flat mounting face.

20. A computer keyboard support system as recited in claim 17, wherein slots are formed in the opposite sides of the keyboard holder means base allowing the mouse pad means to be mounted to extend outwardly from either side of said keyboard holder means.

21. A computer keyboard support system as recited in claim 8, wherein the computer work surface means is a mouse pad means that includes a flat top surface and a bracket that extends from an undersurface of said flat top surface; and means for mounting said mouse pad means to the keyboard holder mount.

22. A computer keyboard support system as recited in claim 2, wherein the first pivoting section includes a bracket for arrangement across and attachment to the top plate and along with the lock sides, is arranged to receive a first bolt, with a nut for turning over a threaded end of said first bolt, and the first pivot coupling includes a pin fitted through the opposite link ends and through said cylindrical pivot bracket; the second pivoting section includes the keyboard holder mount with a second bolt for fitting therethrough and through holes in said lock sides, with a nut for turning over a threaded end of said second bolt that is for fitting with said keyboard holder mount including a hole formed therethrough for receiving a pin fitted therethrough and through aligned holes through the link ends and further including a mounting means centered in a keyboard holder mount forward wall for mounting to the computer accessory holder, said second pivoting section and second pivot couplings to allow said keyboard holder mount to be independently pivoted whereby the computer accessory holder can be tilted up to a nine (9) degree negative angle from the horizontal; and means for clamping said lock sides and links against ends of said bracket and keyboard holder mount.

23. A computer keyboard support system as recited in claim 22, wherein the means for clamping the lock sides and links against the bracket and keyboard holder mount is a lock bolt means arranged for fitting through said lock sides and through a sleeve and is for receiving a nut turned thereover.

24. A computer keyboard support system as recited in claim 23, further including means for maintaining the nut to one lock side as the lock bolt means is turned thereover.

* * * * *